United States Patent [19]

Kawashima

[11] 4,098,205

[45] Jul. 4, 1978

[54] APPARATUS FOR STRETCHING SEWED PORTIONS OF CLOTH IN SEWING OPERATION

[76] Inventor: Yoshirou Kawashima, 18 Higashi-Komazume-cho, Gifu City, Gifu-ken, Japan

[21] Appl. No.: 715,444

[22] Filed: Aug. 18, 1976

[30] Foreign Application Priority Data

| | | | |
|---|---|---|---|
| Sep. 9, 1975 | [JP] | Japan | 50-109321 |
| Nov. 13, 1975 | [JP] | Japan | 50-154937 |
| Dec. 29, 1975 | [JP] | Japan | 50-176478 |
| Jan. 19, 1976 | [JP] | Japan | 51-4323 |

[51] Int. Cl.[2] ..... D05B 27/00

[52] U.S. Cl. ..... 112/217; 38/1 B; 112/147

[58] Field of Search ..... 112/217, 121.26, 121.27, 112/203, 147, 136, 210, 2; 38/1 B, 2, 3

[56] References Cited

U.S. PATENT DOCUMENTS

| | | | |
|---|---|---|---|
| 3,246,616 | 4/1966 | Korioth | 112/217 X |
| 3,478,451 | 11/1969 | Sigoda | 112/217 X |
| 3,587,496 | 6/1971 | Timby | 112/217 |
| 3,934,525 | 1/1976 | Aldred | 112/217 |

FOREIGN PATENT DOCUMENTS

| | | | |
|---|---|---|---|
| 626,761 | 3/1936 | Fed. Rep. of Germany | 112/217 |

*Primary Examiner*—H. Hampton Hunter
*Attorney, Agent, or Firm*—George B. Oujevolk

[57] ABSTRACT

In this apparatus for stretching sewn portions of cloth, comprises a stretching member extends along the feed direction of the cloth in the front and rear of the sewing position of a sewing machine. This stretching member includes an inserting portion which enters into the cloth in the front of the sewing position prior to sewing and a pair of stretching portions for stretching the cloth from both sides with the sewn portion acting as the boundary in the rear of the sewing position. The stretching portions extended backwards in parallel with a predetermined distance between them and the thickness gradually increases towards the rear. A guide member for guiding and shifting the stretched cloth toward the rear extends from the rear end of one stretching portion in the backwards direction with the same thickness as that of the rear end of this stretching portion. A pair of cloth feed devices are disposed in the region extending from the stretching portions to a guide member near the upper and lower faces to perform stretching of the sewn portion and to shift the cloth smoothly. An ironing device is disposed in the vicinity of the inside face of the guide member to iron the stretched portion of the cloth shifted onto the guide member.

9 Claims, 25 Drawing Figures

APPARATUS FOR STRETCHING SEWED PORTIONS OF CLOTH IN SEWING OPERATION

BACKGROUND OF THE INVENTION

This invention relates to an apparatus for stretching sewn portions of cloth in a sewing operation. More particularly, the invention relates to an apparatus for stretching sewn portions of cloth in a process for sewing cloth with a sewing machine, according to the inventive concept the cloth is stretched from both sides with the sewn portion acting as the boundary. The cloth is stretched in the rear of the sewing position of the sewing machine and the ironing of the stretched portion of the cloth is performed automatically and continuously.

In making garments, suits and the like, a cloth sewn by a sewing machine is manually stretched from both the sides with the sewn portion being the boundary and the stretched portion is ironed. These operations of sewing, stretching and ironing, however, have heretofore been one separately and independently, rendering the entire sewing process troublesome and complicated. Especially at the stretching step and ironing step, the side edges of the sewn cloth are pressed and stretched by fingers and the thus stretched portion of the cloth is ironed. Accordingly, much labor and time are required for these operations in case of not only single side sewing where the side edge of the cloth is open but also bagging where the side edge of the cloth is closed, and the efficiency is drastically lowered by these stretching and ironing operations.

It is therefore a primary object of this invention to provide an apparatus for stretching the sewn portion of cloth in which the operations of stretching the cloth from both the sides with the sewn portion being the boundary in the rear of the sewing position of a sewing machine and ironing the stretched portion of the cloth is performed automatically and continuously.

Another object of this invention is to provide an apparatus for stretching the sewn portion of cloth in which when the cloth feed operation of a sewing machine is interrupted and the cloth is taken out from the sewing position of the sewing machine, or when the cloth is shifted forwards and backwards to perform reciprocating sewing on a prescribed part of the cloth, an ironing member is shifted from the position falling in contact with the cloth and there is no risk of burning the cloth by the local heating by the ironing member can be completely expelled.

Still another object of the invention is to provide an apparatus for stretching the sewn portion of cloth in which steam is continuously jetted to the stretched portion of the cloth simultaneously with ironing and uniform iron finish can be imparted to the stretched portion of the cloth.

A further object of this invention is to provide an apparatus for stretching the sewn portion of cloth in which when the cloth feed operation of a sewing machine is interrupted and the cloth is taken out from the sewing position of the sewing machine, or when the cloth is shifted forwards and backwards to perform reciprocating sewing on a prescribed part of the cloth, jetting of steam to the stretched portion is stopped simultaneously with the shifting of an ironing member from the position falling in contact with the stretched portion of the cloth and damage to the finish by local concentrated jet steam is prevented.

Other objects and features of this invention will be apparent from the following detailed description of embodiments thereof and the accompanying in drawings in which. Various advantages not specifically

DETAILED DESCRIPTION

Figure 1:
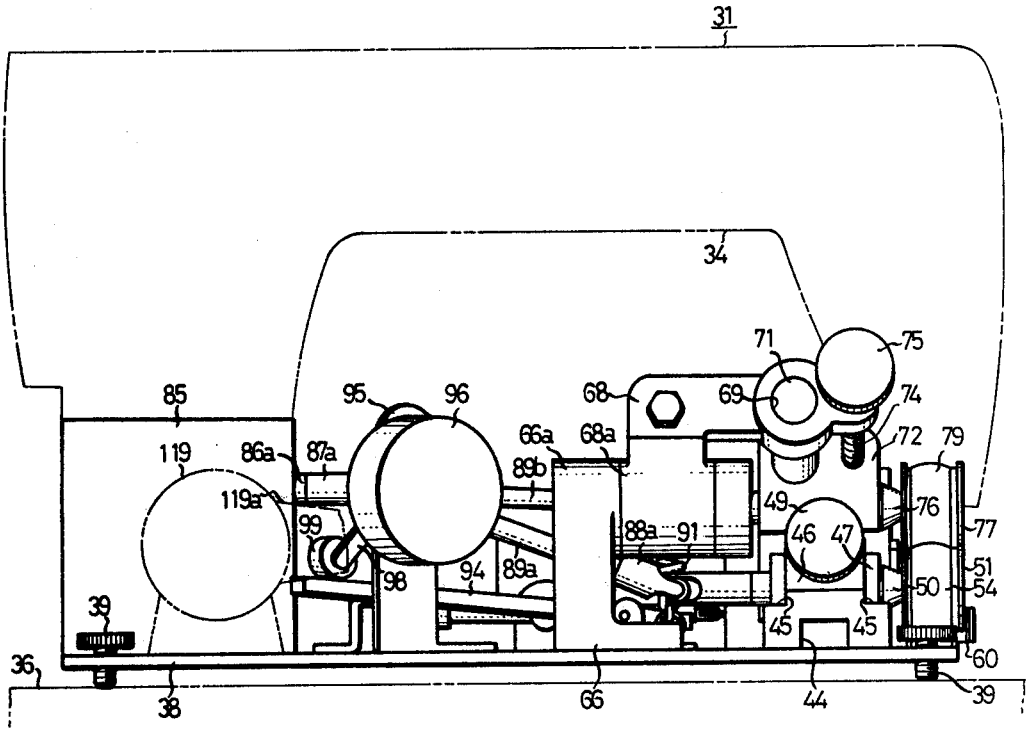
FIG. 1 is a rear view of the stretching apparatus of this invention.

This invention will now be described in detail with reference to embodiments illustrated in the accompanying drawings.

A sewing machine 31 to which the apparatus of this invention is attached comprises an arm 34 having a needle 32 and a cloth pressing leg 33 on the lower portion of the top end and a bed 36 having cloth feed teeth 35 disposed on the upper face confronting the cloth pressing leg 33. This sewing machine 31 is of the linear sewing type in which cloth pieces 37*a* and 37*b* piled together are sewn by co-operative action of the needle 32 and cloth feed teeth 35 at a sewing work station or sewing position. As will be apparent from FIGS. 1 to 3, a bed plate 38 of the apparatus of this embodiment is placed on and fixed to the upper face of the bed 36 of the sewing machine 31, and the vertical position and horizontal position of the bed plate 38 to the bed 36 is adjusted by a plurality of adjusting knobs 39 embedded in the bed plate 38. An attachment portion 40*a* of a stretching member 40 is attached to the side portion of the bed plate 38 so that the stretching member 40 extends along the direction of feeding the cloth by cloth feed teeth 35 in the front and rear of the work station or sewing position of the sewing machine 31 at which the needle 32 is disposed. As will be apparent especially from FIGS. 2 to 7, the stretching member 40 includes an insert portion 41 which enters into the cloth in the front of the sewing position prior to sewing and a pair of stretching portions 42*a* and 42*b* for stretching the cloth pieces 37*a* and 37*b* from both sides with the sewn portion 37*c* sewing as the boundary in the rear of the sewing position, said stretching portions 37*a* and 37*b* extended backwards parallel to each other with a fixed distance between them from the insert portion 41 and have the thickness gradually increased toward the rear. A guide member 43 extends backwards from the rear end of the stretching portion 42*a* with the same thickness as that of the rear end of the stretching portion 42*a*, so that the stretched cloth pieces 37*a* and 37*b* are guided backwards. As is specifically illustrated in FIG. 3, the stretching portions 42*a* and 42*b* of the stretching member 42 are upwardly curved from the position substantially opposite the rear end of the cloth feed teeth 35, so that the rear ends of the stretching portions 42*a* and 42*b* and the guide member 43 are upwardly inclined with respect to the cloth feed direction. Accordingly, as the operation of stretching the sewn portion 37*c* of the cloth pieces 37*a* and 37*b* by the stretching portions 42*a* and 42*b* having a gradually increased thickness, the cloth pieces 37*a* and 37*b* are upwardly guided and shifted.

In order to perform smoothly the operations of stretching the sewn portion 37*c* of the cloth pieces 37*a* and 37*b* and shifting the cloth pieces 37*a* and 37*b*, a pair of cloth feed devices are disposed in the region from the the outer stretching portion 42*a* to the guide member 43 in the proximity to the upper and lower faces thereof. The lower cloth feed device is first described. In the rear of the inner stretching portion 42*b*, a receiving stand 44 is fixed to the upper face of the outside portion of the rear end of the bed plate 38, and as is seen from FIGS. 1 and 3, a pair of sliding faces 45 upwardly inclined with the substantially same inclination angle as that of the guide member 43 are formed on both the side edges of the upper face of the receiving stand 44 and a projection 46 having a hole extending in the same direction as the sliding surfaces 45 is formed on the upper face at the center of the rear end of the receiving stand 44. A supporting member 47 is mounted on each of the sliding surfaces 45 so that it can slide forwards and backwards, and a screw rod 48 projects from the rear face of the supporting member 47 so that it extends toward the rear through the hole of the projection 46. An operation knob 49 is disposed in the hole of the projection 46 so that it can be screwed with the rear end of the screw rod 48 at a shaft 49*a* thereof. By turning of this operation knob 49, the supporting member 47 is shifted forwards and backwards along the sliding surface 45 so that it is set at a desired position. A rotary shaft 50 is rotatably supported so that it penetrates the supporting member 47 and the axis of the shaft 50 crosses the axis of the screw rod 48 at a right angle, also and a large-diameter pulley 51 is pivoted on the outside end portion of the rotary shaft 50 so that the pulley 51 is located below the guide member 43 in the rear thereof. As is seen from FIGS. 2, 3, and 6, below the curved part of the outer stretching portion 42*a*, a small-diameter pulley 53 is rotatably supported on the outer edge of the bed plate 38 through an attachment plate 52. A feed belt 54 extends between the small-diameter pulley 53 and the large-diameter pulley 51.

Figure 3:
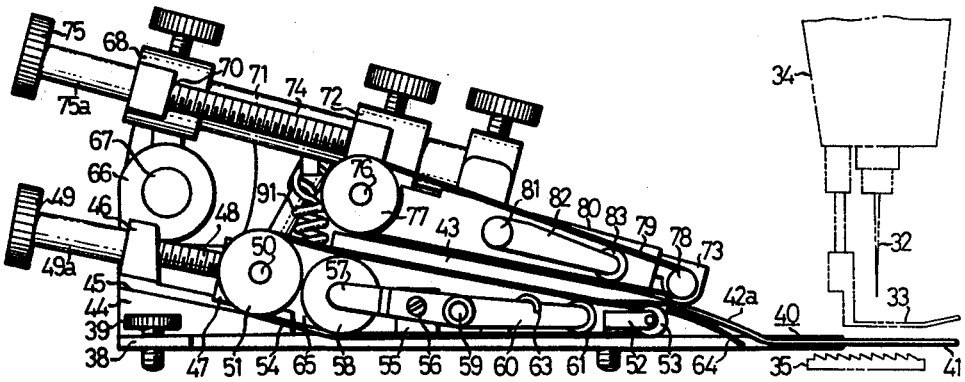
FIG. 3 is a side view of the stretching apparatus of FIG. 1.
Figure 4:
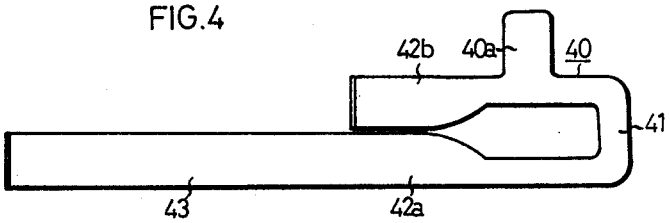
FIG. 4 is a plan view illustrating the stretching member of the stretching apparatus shown in FIG. 1.
Figure 2:
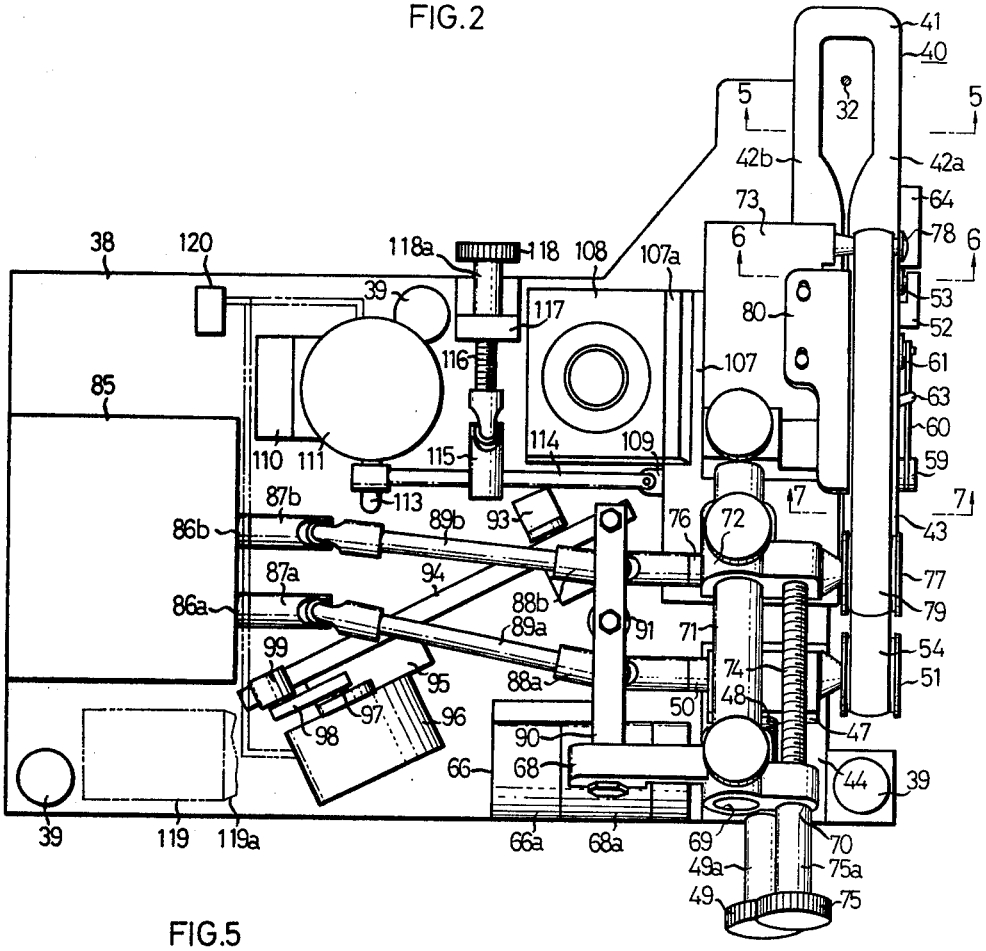
FIG. 2 is a plan view of the stretching apparatus of FIG. 1.
Figure 5:
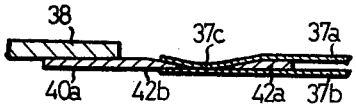
FIG. 5 is an enlarged partial view showing the section taken along the line 5—5 in FIG. 2.
Figure 6:
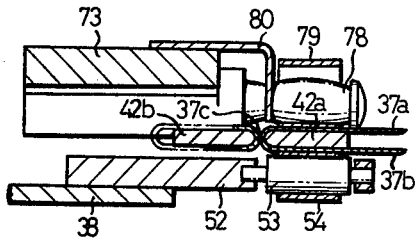
FIG. 6 is an enlarged partial view showing the section taken along the line 6—6 in FIG. 2.
Figure 7:
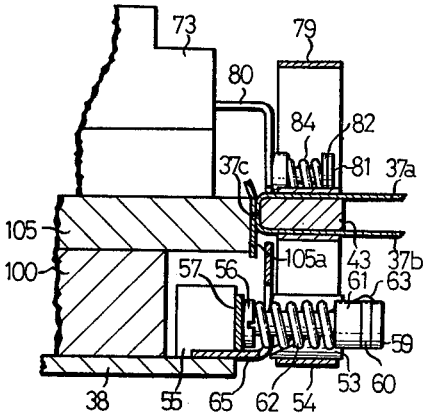
FIG. 7 is an enlarged partial view showing the section taken along the line 7—7 of FIG. 2.
Figure 8:
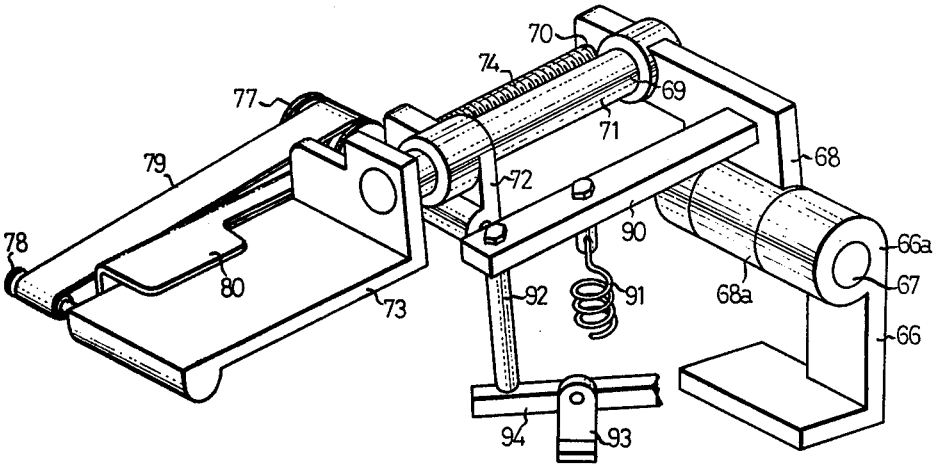
FIG. 8 is a perspective view illustrating the supporting mechanism for the upper cloth feed device shown in FIG. 3.

As will be apparent from FIGS. 2, 3 and 7, an attachment fitting 55 is mounted on the upper face of the outer side of the bed plate 38 in the front of the large-diameter pulley 51, and an attachment arm 57 is fixed to the outer face of the fitting 55 by means of a screw 56. A guide roller 58 is rotatably supported on the rear end of the attachment arm 57 so that it is able to fall in contact with the inner circumferential face of the lower part of the feed belt 54, and a supporting shaft 59 is projected from the outer side of the rear end of the attachment arm 57. A rotary lever 60 is rotatably supported on the outer end portion of the supporting shaft 59, and a press roller 61 is rotatably supported on the front end portion of the supporting shaft 59 so that it can have contact with the inner circumferential face of the upper part of the feed belt 54. As shown in FIG. 7, a spring 62 wound on the outer periphery of the supporting shaft 59 is so disposed that one end is attached onto the rotary lever 60 and the other end fixed to attachment arm 57, so that the spring 62 urges the rotary lever 60 to turn in the counterclockwise direction in FIG. 3. On the upper face of the outer side portion of the bed plate 38, a stopper 63 projects so that it can be engaged with the top end of the rotary lever 60 to control turning of the rotary lever 60 by the spring 62. Accordingly, the upper part of the feed belt 54 is upwardly pressed by the press roller 61 and is moved in this state along the lower faces of the stretching portion 42*a* of the stretching member 40 and the guide member 43. As shown in FIGS. 2 and 3, a guide plate 64 having a curved shape is disposed below the curved part of the outer stretching portion 42*a* in the front of the small-diameter pulley 53, so that the sewn lower cloth piece 37*b* is introduced between the stretching portion 42*a* and the feed belt 54. Further, as is seen from FIGS. 3 and 7, a partition plate 65 is projected from the upper face of the outer side portion of the bed plate 38, so that it is vertically located between the upper and lower parts of the feed belt 54 outside the inner end edge of the outer stretching portion 42*a*.

The upper cloth feed device is now described. As will apparent from FIGS. 1, 2, 3 and 8, an attachment member 66 is fixed to the upper face of the rear end of the bed plate 38 near the receiving stand 44, and a supporting shaft 67 which extends outwards projects from a bearing portion 66*a* formed on the top end of the attachment member 66. A bearing portion 68*a* formed on the lower end of a supporting frame 68 is supported on the supporting shaft 67 so that the supporting frame 68 can turn. Two holes 69 and 70 extending in the direction at right angles to the axis of the supporting shaft 67 are formed on the top end of the supporting frame 68. A base portion of a supporting rod 71 is fitted and fixed into one hole 69 formed on the supporting frame 68, and this supporting rod 71 is extended so that it inclines downwards toward the front with substantially the same angle of inclination as the stretching portions 42*a* and 42*b* of the stretching member and of the guide member 43. A supporting member 72 is supported on the top end of the supporting rod 71 so that the supporting member 72 can slide forwards and backwards, and also a receiving stand 73 is attached to the top end of the supporting rod 71. A screw rod 74 projects from the rear face of the supporting member 72 and this screw rod 74 extends backwards through the other hole 70 of the supporting frame 68. An operation knob 75 is turnably attached in the hole 70 so that a knob shaft 75*a* of the operation knob 75 is screwed to the rear end of the screw rod 74. By turning of the operation knob 75, the supporting member 72 is backwardly and backwardly shifted forwards and backwards along the supporting rod 71, so that the supporting member 72 is set at a desired position. A rotary shaft 76 penetrating the supporting member 72 is supported so that the axis of the shaft 76 crosses the axis of the screw rod 74 at right angles, and a large-diameter pulley 77 is fixed on the outer end portion of the shaft 76 so that the pulley 77 is located above the rear end of the guide member 43. As is seen from FIGS. 2, 3, 6 and 8, above the curved part of the outer stretching portion 42*a*, a small-diameter pulley 78 is rotatably supported on the outer portion of the front edge of the receiving stand 73, and a feed belt 79 is hung between the small-diameter pulley 78 and the large-diameter pulley 77.

As will be apparent from FIGS. 3, 6, 7 and 8, a partition plate 80 is attached to the upper face of the outer portion of the receiving stand 73 to correspond to the partition plate 65 of the lower feed device, and also this partition plate 80 is vertically disposed between the upper and lower parts of the feed belt 79. A supporting shaft 81 projects from the outer side face of the partition plate 80 so that it is located between the upper and lower parts of the feed belt 79. The rear end of a rotary lever 82 is supported on the outer end of the supporting shaft 81 so that the lever 82 can turn. A press roller 83 is rotatably supported on the front end of the rotary lever 82 so that the roller 83 has contact with the inner face of the lower part of the feed belt 79. As is seen from FIG. 7, a spring 84 wound on the supporting shaft 81 is so disposed that the ends thereof are on the rotary lever 82 and the partition plate 80 so as to urge the rotary lever 82 to rotate in the clockwise direction in FIG. 3. Accordingly, the lower part of the feed belt 79 is pressed down by the press roller 83 and is shifted along the upper faces of the outer stretching portion 42*a* of the stretching member 40 and the guide member 43.

A reduction gear device 85 is disposed on the upper face of the bed plate 38 to drive the upper and lower cloth feed devices, and a pair of driving shafts 86*a* and 86*b* project from the side face of the device 85 and are rotated at variable speeds by the power drive of the sewing machine 31. As is illustrated in FIG. 2, a connecting shaft 89*a* is disposed between one driving shaft 86*a* and the inner end portion of the rotary shaft 50 of the lower cloth feed device through ball joints 87*a* and 88*a*. Another connecting shaft 89*b* is disposed between the other driving shaft 86*b* and the inner end portion of the rotary shaft 76 of the upper cloth feed device through ball joints 87*b* and 88*b*. Accordingly, when the cloth pieces 37*a* and 37*b* are sewn by the co-operative action of the needle 32 and cloth feed teeth 35 on actuation of the sewing machine 31, the driving shafts 86*a* and 86*b* are rotated in reverse directions by the reduction gear device 85, and these rotations are transmitted to the rotary shafts 50 and 76, respectively, through ball joints 87*a* and 87*b*, connecting shafts 89*a* and 89*b* and ball joints 88*a* and 88*b*. By rotations of these rotary shafts 50 and 76, the large-diameter pulleys 51 and 77 of the upper and lower cloth feed devices are turned in reverse directions, and the sewn cloth pieces 37*a* and 37*b* are smoothly shifted upwards along the guide member 43 in the backward direction, while they are stretched with the sewn portion 37*c* acting as the boundary by the stretching member 40.

Figure 9:
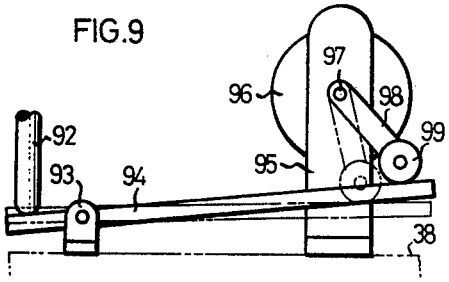
FIG. 9 is a front view illustrating the shifting device for shifting the upper cloth feed device shown in FIG. 3.
Figure 12:
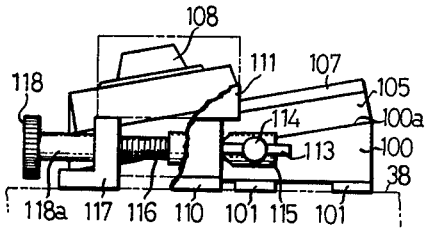
FIG. 12 is a side view illustrating the ironing device and shifting device shown in FIG. 10.

When the operation of the sewing machine 31 is temporarily stopped to interrupt the cloth feeding action of the cloth feed teeth 35 or when the direction of feeding of the cloth by the cloth feed teeth 35 is changed over to the reverse direction by a reversing lever (not shown), the upper feed device is turned in the counterclockwise direction in FIG. 3 with the supporting shaft 67 being the center of rotation and is thus separated from the upper faces of the stretching member 40 and the guide member 43. As will be apparent from FIGS. 2, 8 and 9, a driving arm 90 is mounted on the front face of the base portion of the supporting frame 68 and a spring 91 is disposed between the driving arm 90 and the bed plate 38. An operation lever 92 is mounted on the lower face of the top end of the arm 90. In ordinary operation, the upper cloth feed device is urged and rotated in the clockwise direction in FIG. 3 by the spring 91 and the lower part of the feed belt 79 is located in proximity to the top faces of the outer stretching portion 42*a* and the guide member 43. A rotary lever 94 corresponding to the operation lever 92 is rotatably supported on the upper face of the bed plate 38 through an attachment fitting 93, and the lower end of the operation lever 92 falls in contact with the upper face of one end portion of the rotary lever 94. In ordinary operation, the rotary lever 94 is maintained in the inclined state as indicated by a solid line in FIG. 9. A solenoid 96 opposite the other end portion of the rotary lever 94 is disposed on the upper face of the bed plate 38 through an attachment fitting 95 and when the solenoid 96 is excited, a rotary shaft 97 mounted on the front face of the solenoid 96 is rotated by a prescribed angle in the clockwise direction. A swinging lever 98 is fixed to the front end of the rotary shaft 97, and a press roller 99 is rotatably supported on the top end portion of the swinging lever 98 so that it falls in contact with the upper face of the other end portion of the rotary lever 94. In this arrangement, when the cloth feed operation is interrupted or the feed direction is changed over to a reverse direction, the solenoid 96 is excited to turn the swinging lever 98 in the clockwise direction from the position as indicated by a solid line in FIG. 9, and the rotary lever 94 is turned to the position indicated by a chain line in FIG. 9 and the top end of the driving arm 90 is pushed upwardly, whereby the upper cloth feed device is turned with the supporting shaft 67 being as the center of the rotation in such a direction that it separates from the upper faces of the stretching member 40 and the guide member 43. Members present above the stretching member 40 and the guide member 43 are shifted away and dismounting or back feeding of the cloth pieces 37*a* and 37*b* becomes possible. When the cloth pieces 37*a* and 37*b* are stretched or when they are dismounted, since the rear end of the inner stretching portion 42*b* of the stretching member 40 is opened, even in case of bagging where the side edge of the cloth is closed as indicated by a chain line in FIG. 6, the bag portion can easily be taken out backwards of the stretching portion 42*b*.

Figure 10:
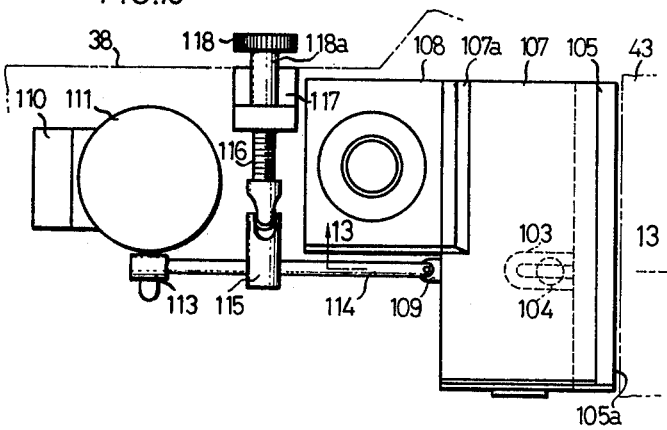
FIG. 10 is a plan view illustrating the ironing device and the shifting device for shifting this ironing device.
Figure 13:
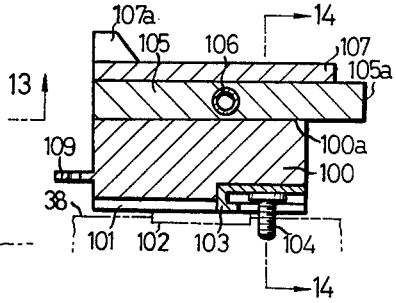
FIG. 13 is a partial view illustrating the section taken along the line 13—13 in FIG. 10.
Figure 11:
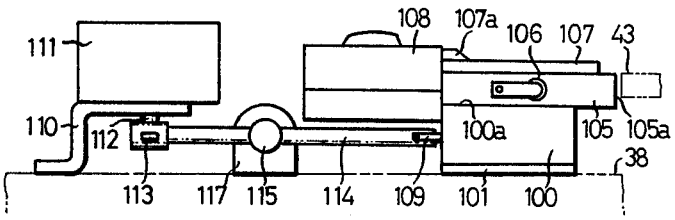
FIG. 11 is a back view illustrating the ironing device and shifting device shown in FIG. 10.
Figure 14:
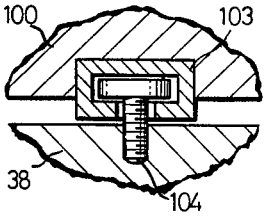
FIG. 14 is an enlarged partial view illustrating the section taken along the line 14—14 in FIG. 13.

The cloth pieces 37*a* and 37*b* wich have been stretched by the stretching member 40 and shifted on th guide member 43 are then ironed by an ironing device disposed near the inner side face of the guide member 43. The structure of this ironing device is outlined in FIGS. 2 and 7 and detailed in FIGS. 10 to 14. An iron supporting member 100 composed of an insulating material is disposed on the upper face of the bed plate 38 in the front portion thereof so that the iron supporting member 100 can be moved to come close to or spaced from the guide member 43 through a bearing 102 on rails 101 laid on both the front and rear side edges of the lower face of the iron supporting member 100. On the upper face of the supporting member 100, there is formed a placing face 100*a* inclined upwardly toward the rear along the guide member 43. As shown in FIGS. 10, 13 and 14, a channel member 103 opened downwardly is fixed to the rear portion of the lower face of the supporting member 100, and a head of a guide pin 104 which projects from the upper face of the bed plate 38 is slidably disposed in the channel member 103 to guide the iron supporting member 100. On the placing face 100*a* of the supporting member 100, there is fixed a heating plate 105 having a heating face 105*a* facing the inside face of the guide member 43 with a small clearance therebetween, and an electric heating source 106 is embedded in the interior of the heating plate 105 as shown in FIG. 13. A cover plate 107 composed of an insulating material is attached on the upper face of the heating plate 105 and a temperature adjusting device 108 is mounted on a projection 107*a* formed on the upper face of the side edge portion of the cover plate 107.

When the operation of the sewing machine 31 is temporarily stopped to stop the operation of feeding the cloth by the cloth feed teeth 35 or when the feeding direction of the cloth by the cloth feed teeth 35 is changed over to a reverse direction by the backing lever, with the above-mentioned movement of the cloth feed device, the ironing device having the described structure is shifted from the position near the guide member 43 to a position spaced therefrom. As is clearly shown in FIGS. 2, 10, 11 and 12, an attachment piece 109 projects from the side face of the supporting member 100 located on the side opposite to the channel member 103, and a solenoid 111 is attached on the upper face of the bed plate 38 through an attachment fitting 110 on the side of the attachment piece 109, and when the solenoid 111 is excited, a rotary shaft 112 projecting from the lower face of the solenoid 111 is rotated by a prescribed angle in the clockwise direction in FIG. 10. A rotary lever 113 is fixed to the lower end of the rotary shaft 112, and the top end of a connecting rod 114 rotatably attached to the attachment piece 109 is slidably fitted on the rotary lever 113. When the solenoid 111 is excited on interruption of the cloth feed operation or changeover of the feed direction, the rotary lever 113 is turned in the clockwise direction in FIG. 10 to move the ironing device to the left in FIG. 10 through the connecting rod 114 and separate the heating face 105*a* of the heating plate 105 from the inner side face of the guide member 43. Accordingly, while the sewing machine 31 is normally operated, the operations of sewing, stretching and ironing of the cloth pieces 37*a* and 37*b* are preformed automatically and continuously. On the other hand, when the operation of the sewing machine 31 is stopped, since the heating plate 105 is separated from the guide member 43, burning of the sewn portion by local heating by the ironing device is prevented.

The ironing device is constructed and arranged so that the distance between the heating face 105*a* of the heating plate 105 and the inner side face of the guide member 43 can be adjusted depending on the thickness of the cloth pieces 37*a* and 37*b* by changing the position of the ironing device. More specifically, a ball joint 115 is attached at the center of the connecting lever 114 and a screw rod 116 projects before the ball joint 115, and a supporting fitting 117 projects on the upper face of the bed plate 38 so that the front end portion of the screw rod 116 penetrates the supporting fitting 117. An operation knob 118 is rotatably supported in the penetration hole of the supporting fitting 117 so that the axis 118*a* of the operation knob 118 is screwed with the front end of the screw rod 116. Accordingly, by turning the operation knob 118 depending on the thickness of the cloth pieces 37*a* and 37*b*, the connecting rod 114 is shifted forwards or backwardly through the screw rod 116 and the ball joint 115 and this connecting rod 114 is swung with the part connected to the rotary lever 113 being as the center, whereby the iron supporting member 100 is shifted to the left or right in FIG. 10. Thus, the distance between the heating face 105*a* of the heating plate 105 and the inner side face of the guide member 43 is adjusted appropriately depending on the thickness of the cloth, and the cloth can be shifted smoothly and a good iron finish can be imparted to the stretched portion of the cloth.

As indicated by a chain line in FIGS. 1 and 2, a fan 119 is mounted on the upper face of the bed plate 38 in proximity to the reduction gear device 85, and an air feed nozzle 119*a* projected on the side of the fan 119 is opened in the vicinity of the rear end of the guide member 43 to cool the ironed cloth pieces 37*a* and 37*b*. A switch 120 which cooperates with the backing lever (not shown) or the like of the sewing machine 31 is mounted on the upper face of the bed plate 38, so that when the sewing machine 31 is temporarily stopped to interrupt the cloth feed operation of the cloth feed teeth 35 or the direction of feeding of the cloth by the cloth feed teeth 35 is changed over to a reverse direction, both the solenoids 96 and 111 are simultaneously excited to shift the cloth feed device and the ironing device and separate them from the cloth.

Figure 15:
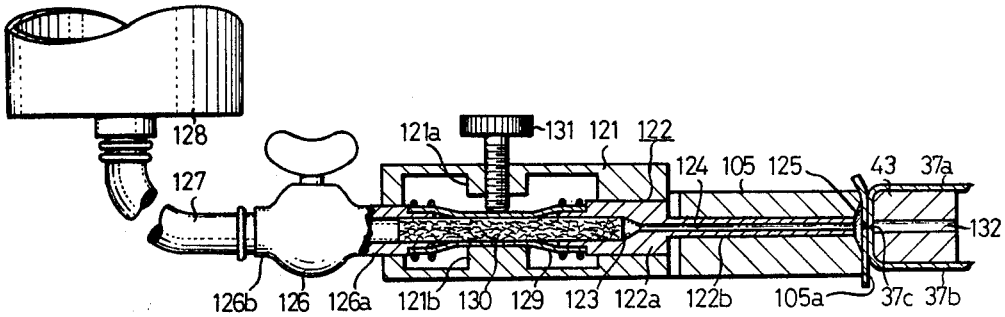
FIG. 15 illustrates an embodiment of the steam feed device disposed near the ironing device.
Figure 16:
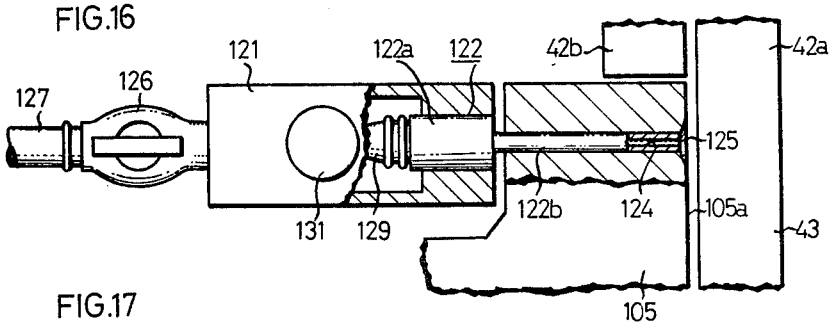
FIG. 16 is a partially cut-out view of the device shown in FIG. 15.

A stem supply device is disposed so that steam is jetted to the stretched portion of the cloth pieces 37*a* and 37*b* simultaneously with the ironing operation by the ironing device. One embodiment of this steam supply device is illustrated in FIGS. 15 and 16. In this embodiment, a casing 121 composed of a heat insulating material is disposed in the vicinity of the ironing device and projections 121*a* and 121*b* are formed on the upper and lower inner faces of the casing 121 so that they face each other. A heating cylinder 122 composed of a material having a good thermal conductivity is penetrated into and fixed to one end of the casing 121 at a large-diameter portion 122*a* thereof. A small-diameter portion 122*b* of the heating cylinder 122 which extends from the large-diameter portion 122*a* in the side is embedded in the front end portion of the heating plate 105 in the direction at right angles to the cloth feed direction. In the heating cylinder 122, a large-diameter tapered hole 123 and a small-diameter steam hole 124 are formed in the region covering the large-diameter portion 122*a* and the small-diameter portion 122*b*. A funnel-like steam jetting opening 125 is formed on the heating face 105*a* of the heating plate 105 to confront the top end opening of the steam hole 124. On the other end portion of the casing 121, a water discharge opening 126*a* of a valve 126 is fixed to penetrate the end portion of the casing 121 and confront the inner end of the large-diameter portion 122*a* of the heating cylinder 122. A water supply opening 126*b* of the valve 126 is connected to a water tank 128 through a water supply pipe 127.

In the casing 121, a flexible tube 129 composed of a heat insulating material is disposed between the inner end of the large-diameter portion 122*a* of the heating cylinder 122 and the inner end of the water discharge opening 126*a* of the valve 126, and a core material 130 having a liquid permeability, such as glass fiber, is contained in the flexible tube 129 so that it enters into the tapered hole 123 and the water discharge opening 126 at both the ends of the tube 129. An adjustment screw 131 is screwed into the casing 121 through the upper projection 121*a*, and the flexible tube 129 is disposed between the lower end of the adjustment screw 131 and the lower projection 121*b*, so that the compression state of the core material 130 can be adjusted by the adjustment screw 131. In the steam supply device of this embodiment, if the compression state of the core material 130 is appropriately adjusted by the adjustment screw 131, water in the water tank 128 is containuously supplied into the flexible tube 129 through the water supply pipe 127 and the valve 126 and a prescribed amount of water is permeated and contained in the core material 130. When the heating plate 105 of the ironing device is heated during the sewing operation of the sewing machine 31, also the small-diameter portion of the heating cylinder 122 embedded in the heating plate 105 is also heated and this heat is transferred to the large-diameter portion 122*a*.

Accordingly, one end portion of the core material 130 inserted into the tapered hole 123 of the large-diameter portion is fully heated throughout the outer periphery thereof, and water contained in this portion is heated and converted to steam and the steam is guided to the jetting opening 125 from the steam hole 124 and jetted continuously to the stretched portion of the cloth pieces 37*a* and 37*b*. In this embodiment, as shown in FIG. 15, a penetrating hole 132 confronting the steam jetting opening 125 is formed on the guide member 43. Accordingly, the steam jetted from the steam jetting opening 125 is fully jetted on the stretched portion of the cloth and simultaneously, a part of the steam passes through the cloth pieces 37*a* and 37*b* and discharged to the outside through the penetrating hole 132. Accordingly, with the movement of the cloth, the stretched portion thereof is uniformly wetted and a uniform iron finish can be imparted to the stretched portion of the cloth by the heating plate 105 of the ironing device.

Figure 17:
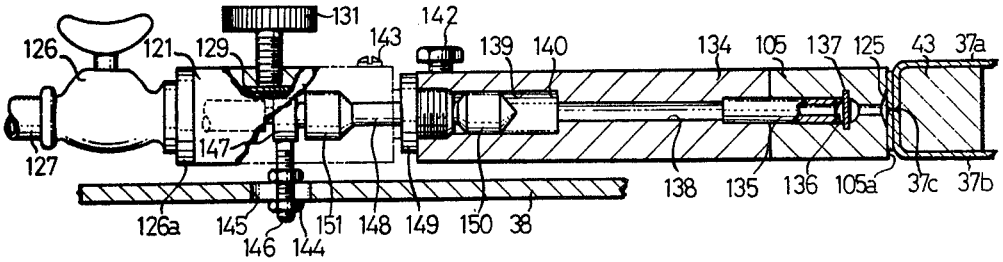
FIG. 17 is a partially cut-out back view of another embodiment of the steam feed device provided with a steam stopping mechanism.
Figure 18:
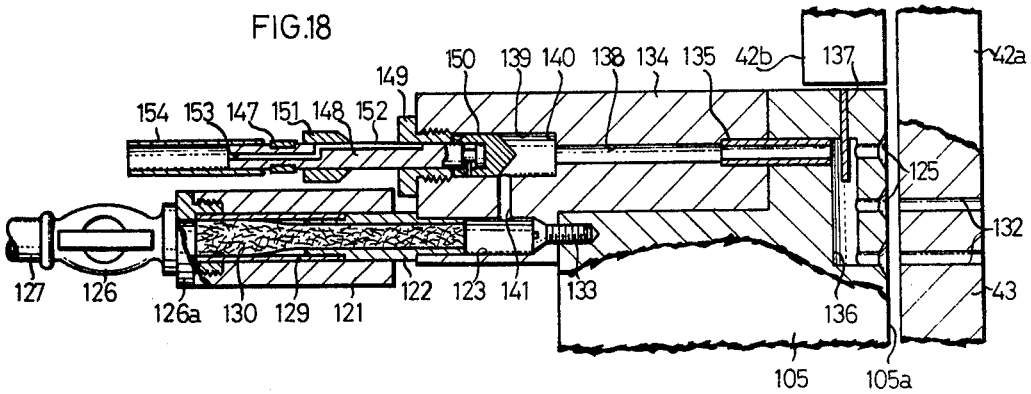
FIG. 18 is a partially cut-out view of the device shown in FIG. 17.
Figure 19:
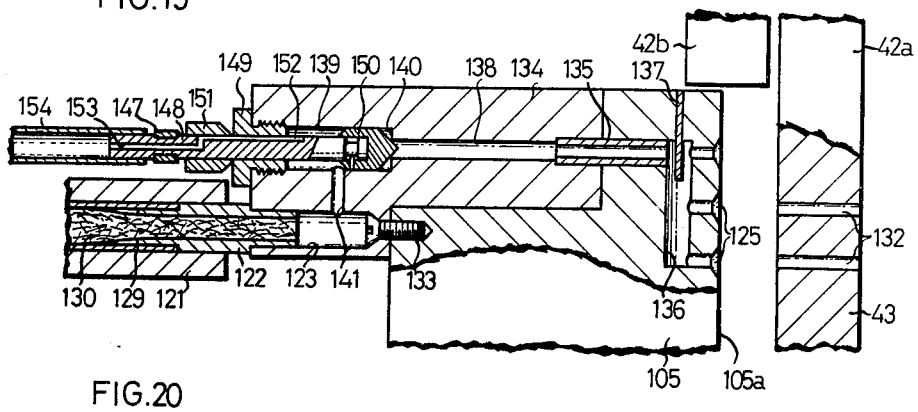
FIG. 19 is a partially cut-out view showing the operation state of the device illustrated in FIG. 18.

Another embodiment of the steam supply device is illustrated in FIGS. 17 to 19. In this embodiment, jetting of steam from the steam jetting opening is stopped when the cloth feed operation of the sewing machine is interrupted and the ironing device is shifted and separated from the guide member 43. In FIGS. 17 to 19, members same as or similar to those in FIGS. 15 and 16 are indicated by the same reference numerals as used in FIGS. 15 and 16. Referring now to FIGS. 17 to 19, an attachment member 134 composed of a material having good thermal conductivity is attached to the front edge of a heating plate 105 of the ironing device through at attachment screw 133, and a connecting tube 135 is laid between the side end portion of the attachment member 134 and the heating plate 105. A steam passage 136 is formed in the heating plate 105 in parallel to the cloth feed direction so that it is communicated with the connecting tube 135. A plurality of funnel-like steam jetting openings 125 are formed to extend from the steam passage 136 to the heating surface 105*a*. In the steam passage 136, an intercepting plate 137 is projected so that it is located between the top end portion of the connecting tube 135 and the foremost steam jetting opening 125, and as shown in FIG. 18, the steam from the connecting tube 135 detours the intercepting plate 137 and is then introduced to the foremost steam jetting opening 125. In this embodiment, penetrating holes 132 are formed in the guide member 43 so that they confront two rear steam jetting openings 125. A small-diameter steam passage 138 and a large-diameter containing hole 139 are formed in the attachment member 134 coaxially with the connecting tube 135 so that they are connected to the connecting tube 135. A valve seat 140 is formed on a connecting portion of the steam passage 138 to the containing hole 139. A tapered hole 123 is formed in the attachment member 134 in parallel to the containing hole 139, and a connecting hole 141 is formed between the tapered hole 123 and the containing hole 139. A heating cylinder 122 is projected from the outside of the attachment member 134 and fixed thereto by a bolt 142 so that one end of the heating cylinder 122 is fitted in the tapered hole 123. The other end of the heating cylinder 122 is projected into the casing 121 and fixed thereto by means of an attachment screw 143. On the opposite side end of the casing 121, a water discharge opening 126*a* of a valve 126 is disposed so that it penetrates said side end of the casing 121. A flexible tube 129 composed of a heat insulating material is laid between the water discharge opening 126*a* and the heating cylinder 122. A core material 130 having a liquid permeability, such as glass fiber, is filled in the flexible tube 129 and the heating cylinder 122, and the compression state of the core material 130 is appropriately adjusted by an adjustment screw 131.

A supporting rod 146 is projected from the upper face of the bed plate 38 through a long hole 145 and fixed to the said upper face by a nut 144 so that its position can be adjusted, and a clamp 147 is attached to the top end of the supporting rod 146. A valve rod 148 is fixed to the clamp 147 so that it slidably penetrates a guide member 149 mounted on the end portion of the containing hole 139 of the attachment member 134, and the valve rod 148 is projected into the containing hole 139. A valve 150 for passing or shutting the stream of steam running from a connecting hole 141 to a steam passage 138 is attached to the inner end portion of the valve rod 148 at a position confronting a valve seat 140. As shown in FIG. 19, a stopper 151 to be engaged with the outer side face of the guiding member 149 is fixed onto the outer periphery of the valve rod 148 substantially at the center of the rod 148, and a steam discharge groove 152 is formed to extend on the outer periphery of the valve rod 148 from the stopper 151 to the vicinity of the valve 150. A steam discharge hole 153 is formed outwardly from the stopper 151 in the valve rod 148 and is connected to the steam discharge groove 152. A discharge pipe 154 is connected to the outer end of the valve rod 148 so that steam from the steam discharge hole 153 is introduced to a position spaced from the sewing position of the sewing machine. Accordingly, when the heating plate 105 of the ironing device is located at a position near the guide member 43 as shown in FIG. 18 and operations of sewing, stretching and ironing of the cloth pieces 37*a* and 37*b* are conducted, the valve seat 140 is opened and steam generated in the heating cylinder 122 is fed through the tapered hole 123, connecting hole 141, steam passage 138, connecting tube 135 and steam passage 136 and is continuously jetted from a plurality of steam jetting openings 125 to the stretched portion of the cloth. When the cloth feed operation of the sewing machine is interrupted and the heating plate 105 of the ironing device is shifted to a direction separating from the guide member 43 as shown in FIG. 19, the valve seat 140 is closed by the valve 150 and jetting of steam from the steam jetting holes 125 is stopped. At this point, as is seen from FIG. 19, the steam discharge groove 152 on the valve rod 148 intrudes into the guide member 149 to open the containing hole 139, and a passage connecting the tapered hole 123 to the discharge tube 154 through the connecting hole 141, containing hole 139, steam discharge groove 152 and steam discharge hole 153 is formed. Accordingly, steam generated in the heating cylinder 122 is introduced from the discharge tube 154 to a position spaced from the sewing position of the sewing machine. Thus, a risk of local concentrated jetting of steam on a part of the cloth is completely expelled and a uniform iron finish can be imparted to the cloth.

Another embodiment of the arrangement of the device for adjusting the position of the ironing device to the guide member 43 and the moving device for shifting the ironing device to a direction separating from the guide member 43 is illustrated in FIGS. 20 to 24. In this embodiment, a receiving stand 156 is fixed to the outer side face of an iron supporting member 100 having a heating plate 105 placed thereon by means of an attachment screw 155 and is projected from said outer side face of the supporting member 100. A supporting roller 158 disposed on the bed plate 38 is engaged with the interior of a concave groove 157 formed on the lower face of the receiving stand 156 to extend in the direction crossing rectangularly the cloth feed direction, so that the receiving stand 156 is shifted together with the ironing device in a direction coming close to or separating from the guide member 43 by means of the supporting roller 158. A slide groove 159 is formed on the upper face of the receiving stand 156 to extend in parallel to the concave groove 157, and a pair of containing grooves 160 are formed on the bottom face of the slide groove 159 to extend in the longitudinal direction. A slide member 161 is disposed in the slide groove 159 of the receiving stand 156 so that it can move in the longitudinal direction, and containing grooves 162 are formed on both the side faces of the slide member 161. As will be apparent from FIGS. 20 and 22, a plurality of balls 163 are rotatably contained in each of the containing grooves 160 and 162, so that the slide member 161 can move smoothly along the slide groove 159.

Figure 23:
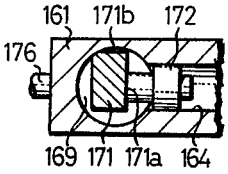
FIG. 23 is a partial view showing the section taken along the line 23—23 in FIG. 21.
Figure 24:
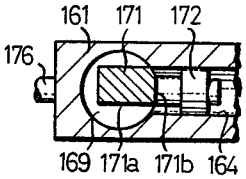
FIG. 24 is a partial sectional view showing the operation state of the device illustrated in FIG. 23.

A penetrating hole 164 is formed at the center of the slide member 161 and is opened toward the iron supporting member 100, and a supporting hole 165 connected to the penetrating hole 164 and extending in the direction crossing rectangularly the axis of the penetrating hole 164 is formed on the outer end portion of the slide member 161. A pressing rod 166 is projected from the outer side face of the iron supporting member 100 and the top end portion of the rod 166 is fitted in the penetrating hole 164 of the slide member 161. A connecting pin 168 is projected from the outer periphery of this fitting portion toward the interior of a long hole 167 of the slide member 161. An adjustment shaft 169 is rotatably supported in the supporting hole 165 of the slide member 161 and an operation knob 170 is mounted in the front of the adjustment shaft 169. An adjustment cam 171 is formed in the central portion of the adjustment shaft 169, and this adjustment cam 171 has a cam face 171*a* located in the vicinity of the rotation axis of the adjustment shaft 169 and a cam face 171*b* located at a position spaced from the rotation axis of the adjustment shaft 169 as shown in FIGS. 23 and 24. A follower 172 is movably disposed in the penetrating hole 164 so that it falls in contact with the cam face 171*a* or 171*b* of the adjustment cam 171, and a pressing spring 173 is disposed between the follower 172 and the pressing rod 166.

Figure 20:
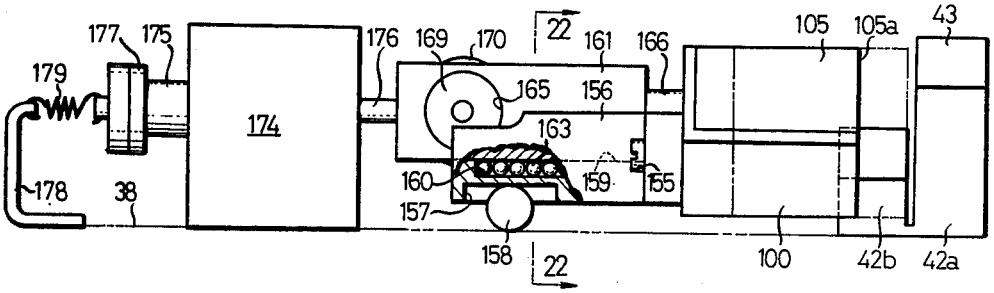
FIG. 20 is a partially cut-out view showing another embodiment of the ironing device and the shifting device for shifting the ironing device.
Figure 22:
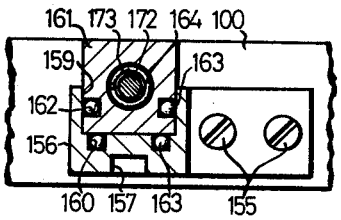
FIG. 22 is a partial view showing the section taken along the line 22—22 in FIG. 20.
Figure 21:
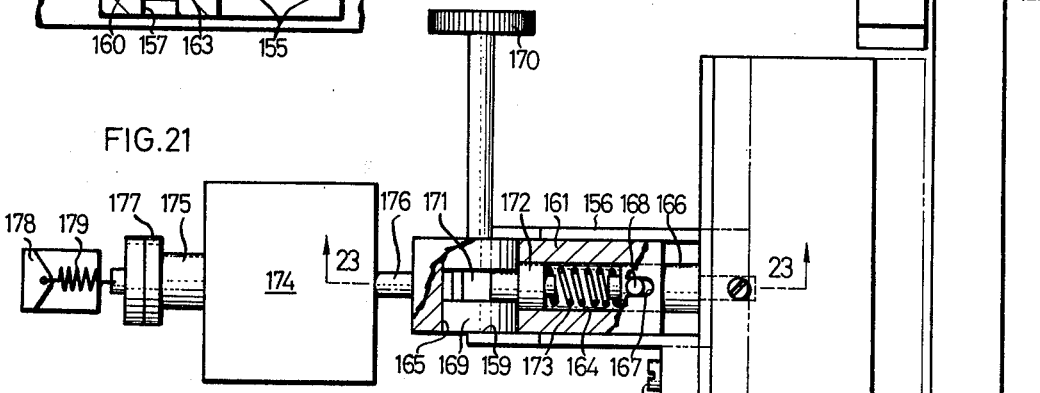
FIG. 21 is a partially cut-out view of the device shown in FIG. 20.

A solenoid 174 is mounted on the upper face of the bed plate 38 on the side of the slide member 161, and a movable iron core 175 of the solenoid 174 is connected to an operation shaft 176 projected from the outer side face of the slide member 161, so that when the solenoid 174 is excited to move the movable iron core 175 to the right in FIGS. 20 and 21, a pressing force is imposed in the same direction as the moving direction of the iron core 175 on the slide member 161. A buffer member 177 is mounted on the top end portion of the movable iron core 175 so that the shock imparted to the movable iron core 175 on excitation of the solenoid 174 is moderated. A return spring 179 is disposed between a hanging fitting 178 projected from the upper face of the bed plate 38 and the movable iron core 175, so that when the solenoid 134 is de-energized, the movable iron core 175 is shifted to the left position shown in FIGS. 20 and 21 and the ironing device is maintained at a position spaced from the guide member 43.

In this embodiment having the structure described, when the solenoid 174 is excited during the sewing operation of the sewing machine, the movable iron core 175 is shifted to the right from the position shown in FIGS. 20 and 21 and a pressing force is imposed in the same direction on the slide member 161 through the operation rod 176, whereby the slide member 161 is shifted to the right in the slide groove 159 of the receiving stand 156 against the pressing spring 173. Then, at the point the compression force of the pressing spring 173 is elevated to a prescribed level, the ironing device and the receiving stand 156 are abruptly shifted to the right, and as indicated by a chain line in FIGS. 20 and 21, the heating face 105*a* of the heating plate 105 is made closer to the inner side face of the guide member 43 and the stretched portion of the cloth can now be ironed. When the operation knob 170 is turned in this state, the adjustment cam 171 is turned to move the follower 172 to the right or left and the compression force of the pressing spring 173 is changed, whereby the relative position of the ironing device to the guide member 43 is minutely adjusted through the pressing rod 166. When the adjustment cam 171 is set so that the lower cam face 171*a* of the cam 171 is engaged with the follower 172 as shown in FIG. 23, the compression force of the pressing spring 173 is made smaller and the spacing between the heating face 105*a* of the heating plate 105 and the inside face of the guide member 43 is broadened. Thus, a condition suitable for ironing a thick cloth is attained. When the adjustment cam 171 is set so that the higher cam face 171*b* of the cam 171 is engaged with the follower 172 as shown in FIG. 24, the compression force of the pressing spring 173 is increased and the spacing between the heating face 105*a* of the heating plate 105 and the inner side face of the guide member 43 is narrowed. Thus, a condition suitable for ironing a thin cloth is attained. When the cloth feed operation is interrupted and the solenoid 174 is de-energized, the movable iron core 175 is returned to the original position by the return spring 179 and the ironing device is shifted to a position spaced from the guide member 43.

Figure 25:
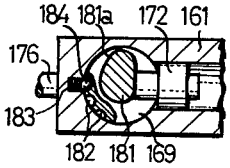
FIG. 25 is a partial sectional view illustrating a modification of the device shown in FIG. 23, in which the cam shape is changed.
Figure 25:
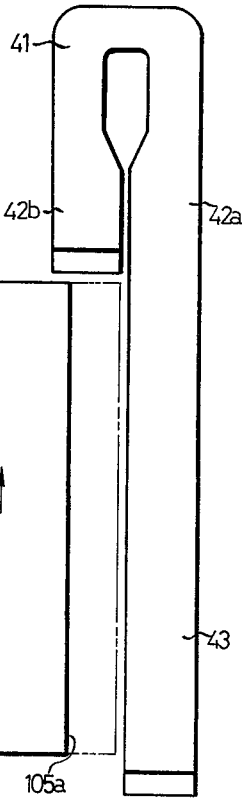

The shape of the adjustment cam 171 is not limited to a polygonal shape as shown in the drawings, and an adjustment cam having a curved shape may be used in this invention. This embodiment is illustrated in FIG. 25. The adjustment cam 181 of this embodiment has a cam face 181*a* of a curved shape located at a position deviated from the rotation axis of the adjustment axis 169. A plurality of engaging holes 182 are formed on the outer periphery of the adjustment shaft 169. An engaging ball 184 pressed inwardly by a spring 183 is mounted on the inner circumferential face of the supporting hole 165 of the slide member 161, so that the ball 184 is selectively engaged with any one of the engaging holes 182 with rotation of the adjustment shaft 169. By engaging the ball 184 with a specific engaging hole 165 so as to set the adjustment cam 181 at a desired position selected from a plurality of the rotation positions, the spacing between the heating face 105*a* of the heating plate 105 and the inner side face of the guide member 43 is appropriately set. In this manner, this spacing can be adjusted at plural stages.

As will be apparent from the foregoing illustration, when the apparatus for stretching the sewed portion of cloth according to this invention is used for sewing cloth by a sewing machine, the operations of stretching the cloth from both the sides with the sewed portion being as the boundary and ironing the stretched portion of the cloth can be performed continuously and automatically, and the operation time required for making a garment or the like can be remarkably shortened. Further, when the cloth feed operation of the sewing machine is interrupted, the ironing device is shifted and spaced from the cloth, and therefore, a risk of burning of the cloth by local excessive heating can be completely expelled assuredly.

This invention has heretobefore been described in detail by reference to most preferred embodiments. It will be apparent to those skilled in the art that various modifications can be made in a broad range without deviation from the spirit and scope of this invention is not limited to specific embodiments but to those specified in the appended claims.

What is claimed is:

1. For a sewing machine with a sewing work station, an apparatus for stretching sewn portions of work cloth which comprises:

a. a stretching member (40) adapted to be disposed to the rear of the sewing work station, said stretching member including an insert portion (41) which enters into the cloth in the front of the sewing work station and a pair of flat stretching portions (42*a*, 42*b*) for stretching the side edge sections of the work cloth from a seam sewn by the sewing machine, said stretching portions having upper and lower faces;

b. a guide member (43) for guiding and shifting the stretched cloth toward the rear, which extends from the rear end of one stretching portion;

c. upper and lower cloth feed devices (55, 66) extending over the upper and lower faces, respectively, of the stretching portions (42*a*, 42*b*) and the guide member (43) to perform stretching of side edge sections of the cloth and shifting of the stretched cloth smoothly;

d. an ironing device disposed in the vicinity of the inner side face of the guide member to iron the stretched side edge sections of the cloth which has been shifted onto the guide member, said ironing device including a supporting member (100), means for moving said supporting member in a direction approaching the guide member (43) or away therefrom and a heating plate (105) supported on said supporting member (100) and having a heating face (105*a*) opposite the inner side face of the guide member (43);

e. first spacing means for spacing the upper cloth feed device from the upper faces of the stretching portions (42*a*, 42*b*) and the guide member (43) when the cloth feed operation of the sewing machine is interrupted; and, f. second spacing means for spacing the ironing device from the inner side face of the guide member (43) when the cloth feed operation of the sewing machine is interrupted.

2. An apparatus according to claim 1 wherein said stretching member (40) is an elongated flat member with a rectangular flat forward insert portion (41) with sides (42*a*, 42*b*) defining stretching portions, a flat rectangular piece (43) defining a guide, and a rectangular attachment portion (40*a*) near said insert portion.

3. An apparatus according to claim 2 wherein said upper and lower cloth feed devices are a pair of pulleys and a feed belt which extends about said pulleys, respectively.

4. An apparatus according to claim 2 wherein said means for spacing the upper cloth feed device includes a solenoid which is operated when the cloth feed operation of the sewing machine is interrupted and a connecting mechanism for connecting the solenoid to the upper cloth feed device co-operatively.

5. An apparatus according to claim 2 wherein said means for spacing the ironing device includes a solenoid which is operated when the cloth feed operation of the sewing machine is interrupted and a connecting mechanism for connecting the solenoid to the ironing device cooperatively.

6. An apparatus according to claim 2 which further comprises adjusting means for adjusting the spacing between the heating face of the heating plate and the inner side face of the guide member under the approacing conditions of the ironing device to the guide member.

7. An apparatus according to claim 2 which further comprises a steam supply device having a steam jetting hole which opens toward the inner side face of the guide member (43) to jet steam to the stretched side edge sections of the cloth simultaneously with ironing.

8. An apparatus according to claim 7 wherein said steam supply device includes a steam generating cylinder embedded in the heating plate of the ironing device in communication with the steam jetting hole, a liquid-permeable core disposed in the steam generating cylinder and a water supply source for supplying water into the steam generating cylinder.

9. An apparatus according to claim 8 wherein said steam supply device includes a steam passage between the steam generating cylinder and the steam jetting hole with a valve for closing said steam passage when the ironing device is spaced from the guide member by said spacing means, and, a steam discharge passage for discharging steam from the steam gnerating cylinder to a position spaced from the sewing position of the sewing machine when said steam passage is closed by the valve.

* * * * *